US006851883B1

(12) United States Patent
Lamond et al.

(10) Patent No.: US 6,851,883 B1
(45) Date of Patent: Feb. 8, 2005

(54) DECORATING APPLICATOR

(76) Inventors: Joan Baillie Lamond, 57 Woodward St., Saddle Brook, NJ (US) 07663; Linda Botcho, 18 Echo Pl., Elmwood Park, NJ (US) 07407

( * ) Notice: Subject to any disclaimer, the term of this patent is extended or adjusted under 35 U.S.C. 154(b) by 0 days.

(21) Appl. No.: 10/426,990

(22) Filed: Apr. 30, 2003

Related U.S. Application Data

(60) Provisional application No. 60/319,219, filed on May 2, 2002.

(51) Int. Cl.[7] ..... B43K 11/06
(52) U.S. Cl. ..... 401/198; 401/201
(58) Field of Search ..... 401/196, 198, 401/199, 201, 207, 40–43

(56) References Cited

U.S. PATENT DOCUMENTS 2,396,058 A * 3/1946 Rath ..... 401/198
3,221,361 A * 12/1965 Cline ..... 401/198
3,457,014 A * 7/1969 Ward ..... 401/41
3,684,389 A * 8/1972 Eron et al. ..... 401/207
6,244,775 B1 * 6/2001 Oike ..... 401/199
6,386,781 B1 * 5/2002 Gueret ..... 401/198
6,428,235 B1 * 8/2002 Takanashi et al. ..... 401/202

* cited by examiner

*Primary Examiner*—Gregory L. Huson
*Assistant Examiner*—Huyen Le
(74) *Attorney, Agent, or Firm*—Richard A. Joel, Esq.

(57) ABSTRACT

A decorating applicator for use in a decorating kit comprises a self-feeding hollow plastic tube or wand having a sponge foam rubber applicator tip at one end and a base at the other end of the tube. The applicator tip is held in place with a plastic plug or cap mounted in the open end of the tube. A food dye is placed within the tube, water added and the plug with the applicator extending therefrom is sealingly mounted in the tube opening. The colored liquid is drawn onto the sponge tip through an aperture in the plug. The tip has a specific tapered configuration to facilitate decorating.

2 Claims, 2 Drawing Sheets

DECORATING APPLICATOR

CROSS REFERENCE TO RELATED APPLICATIONS

This application is based on provisional application Ser. No. 60,319,219 filed May 2, 2002.

BACKGROUND OF INVENTION

This invention relates to decorating kits having a unique applicator and particularly to Easter egg kits, decorating and window stencil kits, summer tee shirt kits, coloring kits and home improvement kits and the like. The applicator of this invention while usually integrated in decorating kits may also be provided separately.

In the prior art, decorating for holidays usually involved dunking eggs in colored liquids or placing stencils on various holiday items. Painting with watercolors involved a great deal of mess and was usually suited only for older children. In addition, the brushes became unsuitable after a limited amount of use. The task of decorating was unenviable with the mess involved.

SUMMARY OF INVENTION

This invention relates to holiday decorating kits and particularly to a wand for decorating eggs and similar holiday items. The wand comprises a hollow transparent tube having a flat seal or loose at one end and an applicator tip at the other end. A colored fluid such as food dye, acrylic paint, tempura paint, latex paint or other similar medium is placed within the tube. The plastic applicator cap comprises a lower portion, which sealingly engages the tube aperture and includes a recess with a base aperture within which a sponge foam rubber tip is mounted. The cap also includes an outwardly extending flange that engages the tube rim and a shaped portion of the rubber tip extending outwardly therefrom to apply coloring to a surface.

A second design eliminates the cap and the sponge is glued directly into the tube. Other embodiments are disclosed in the detailed description.

Accordingly, an object of this invention is to provide a new and improved coloring device for craft and decorating projects of all types.

Another object of this invention is to provide a new and improved holiday decorating medium, which is safe and convenient, and which involves a specially coloring formulated tablet.

A further object of this invention is to provide a new and improved holiday decorating device including a clear or opaque tube containing a coloring fluid and a sponge foam rubber tip for applying the fluid to a surface.

A more specific object of this invention is to provide a new and improved disposable decorating applicator comprising a squeezable clear or opaque plastic tube having a particular color pellet therein which is dissolved in a liquid medium such as water and a sponge foam rubber tip of a predetermined configuration which is used to color a variety of surfaces for craft and home decorating purposes.

BRIEF DESCRIPTION OF DRAWINGS

The above and other objects of the invention may be more readily seen when viewed in conjunction with the accompanying drawings wherein.

FIG. 4 is a front view of a further embodiment of the invention using a screw on base on the sponge tip, and.

DETAILED DESCRIPTION

Figure 1:
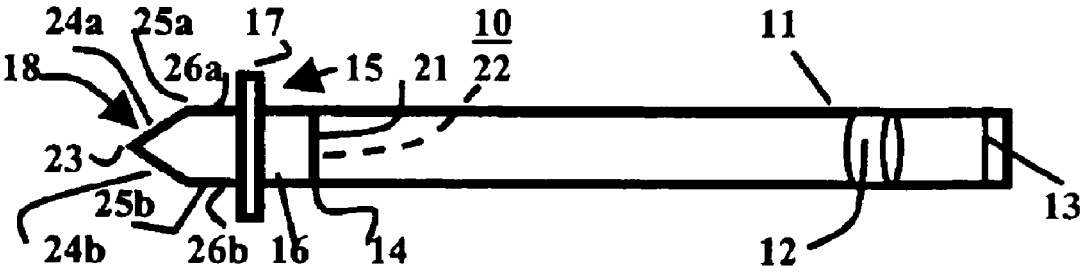
FIG. 1 is a front view of the invention in an assembled condition.
Figure 2:
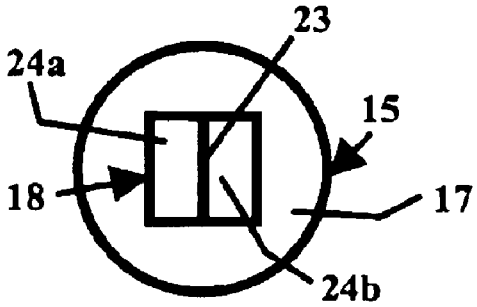
FIG. 2 is an end view of the invention from the tip end.

This invention comprises a holiday decorating device or applicator 10, which includes a plastic tube 11. The tube 11 is made of a lightweight blown or extruded, polyester, polyurethane, polyethylene nylon or acrylic plastic material. The one tube end 12 is sealed with a plastic or metal plug or screw on cap 13 which may be integrally molded to the tube 11. The other end 14 includes a removable cap 15 which comprises a cylindrical plastic lower portion 16 which engages the tube 11 in a force fit, an intermediate flange portion 17 which extends outwardly and a sponge foam rubber applicator tip 18.

The applicator tip 18 is fixedly mounted at one end 27 within the hollow cylindrical portion 16 and extends outwardly from the flange portion 17. The base 21 of the cylindrical lower portion 16 includes an aperture 22 which permits liquid from the tube 11 to reach the tip 18. The tip 18 includes a sloped outer ridge 23 formed by inclined faces 24*a*, 24*b* which comprise the coloring faces. The faces 24*a*, 24*b* are substantially rectangular in configuration and each include an edge 25*a*, 25*b* which forms one side of a substantially triangular face 26*a*, 26*b*.

Figure 3:
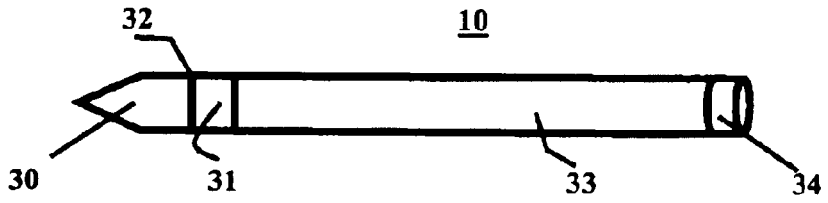
FIG. 3 is a front view of an alternate embodiment of the invention with the sponge tip glued within the tube aperture.

FIG. 3 depicts an alternate embodiment of the invention wherein the cylindrical end 31 of a sponge tip 30 is glued within the aperture 32 of the tube 33 to the internal tube wall. The other end of the tube 33 is sealed by plug 34.

Figure 4:
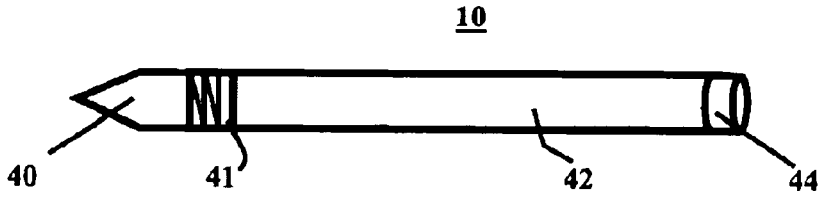

FIG. 4 depicts a further embodiment of the invention wherein the sponge tip 40 includes a screw on base 41 that engages threads on the cylinder 42 to cap the cylinder 43. A fixed plug 44 seals the outer end.

Figure 5:
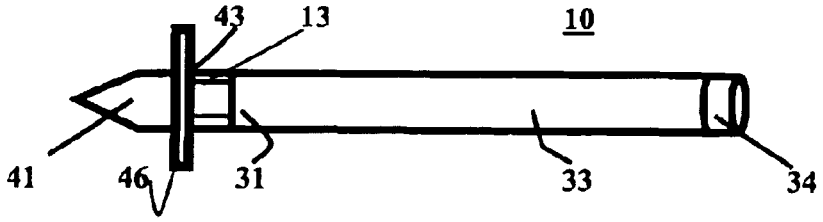
FIG. 5 is an alternate embodiment of the invention using a force fit.

FIG. 5 depicts an embodiment wherein the cylindrical end 31 of the sponge tip 41 is mounted within an aperture in the cylindrical portion of cap 13. The cap 13 includes an outwardly projecting outer ring 46 about the upper surface thereof, which engages the lip 43 of the tube 11. The cylindrical end 31 of the sponge tip 41 extends downwardly within the cylindrical portion of the cap 13. The cap 13 is force fit in the tube aperture after the coloring fluid has been fed into the tube.

In operation, the applicator cap 15 is removed and warm water is added to the clear tube 11 that includes a safe food-dye color pellet 12 mounted therein. The cap 15 is replaced and the tube 11 is let rest for three to five minutes. The tube 11 is then shaken to distribute the coloring solution in the tube 11. Next, the tube 11 is gently squeezed and the tip 18 daubed to get the color started. Pictures can be colored on blank paper to get the sponge tip 18 primed. The device which is marketed under the name "Mag-egg Wand" is now ready for use.

After use, the wand 10 may be thrown away and the remaining liquid may be discarded or the remaining liquid may be emptied down the drain and the wand 10 placed in the plastic recycling bin.

The wand 10 is easy to use since all that is required is to add warm water and shake. A child can use the wand 10 that includes a specially formulated safe tablet that provides more fun with less mess. No preparation, mixing or vinegar is required. There are no pots and disposing and clean up is easy.

The self-feeding tube 11 may be used as a delivery system (1) applying food dye or coloring to egg shells; (2) applying acrylic paint to fabric; (3) applying tempura paint to pumpkins; or paper (4) applying colored glass wax or polish or glass paint to glass surfaces; (5) applying latex paint to wood or plaster or other painted surfaces. The decorating kits including the wand 10 will be both seasonal and non-seasonal in nature and distributed for decorating projects throughout the year.

While the invention has been explained by a detailed description of certain specific embodiments, it is understood that various modifications and substitutions can be made in any of them within the scope of the appended claims, which are intended also to include equivalents of such embodiments.

What is claimed is:

1. A decorating applicator for applying a colored liquid to an article being decorated comprising:

a hollow elongated plastic cylindrical tube having a base at one end and an aperture at the other end said tube being dimensioned to accommodate a color pellet which dissolves upon the feeding of water into the tube;

a hollow cylindrical cap having a top surface including an aperture and an outwardly projecting rim and a downwardly projecting wall for force fit insertion into the tube aperture, and;

a sponge foam rubber applicator having a lower portion projecting through the aperture in the hollow cap to contact the liquid in the tube and an upper portion having two opposite sides which project upwardly from the cap and then inwardly at an angle to form a pointed edge, said sides having upwardly projecting parallel surfaces joining said opposite sides together.

2. The method of applying decorative colors to an object comprising the steps of:

providing a hollow elongated tube having a base at one end and an aperture at the other end;

inserting a color dye pellet into the tube;

adding liquid to the tube to dissolve the pellet forming a colored solution;

affixing a cap over the tube aperture; and, providing a sponge applicator extending downward through the cap to contact the colored solution and upwardly therefrom to provide an applicator surface for the colored liquid.

* * * * *